US005614692A

United States Patent [19]

Brown et al.

[11] Patent Number: 5,614,692

[45] Date of Patent: Mar. 25, 1997

[54] SHAPED-CHARGE DEVICE WITH PROGRESSIVE INWARD COLLAPSING JET

[75] Inventors: Ronald E. Brown, Danville, Calif.; Mark E. Majerus, Middletown, Del.

[73] Assignee: Tracor Aerospace, Inc., Austin, Tex.

[21] Appl. No.: 497,541

[22] Filed: Jun. 30, 1995

[51] Int. Cl.[6] ..... F42B 1/02

[52] U.S. Cl. ..... 102/307; 102/308

[58] Field of Search ..... 102/307, 308

[56] References Cited

U.S. PATENT DOCUMENTS

| | | | |
|---|---|---|---|
| 3,797,391 | 3/1974 | Cammarata et al. | 102/4 |
| 4,436,033 | 3/1984 | Precoul | 102/307 |
| 4,498,367 | 2/1985 | Skolnick et al. | 86/1 |
| 4,537,132 | 8/1985 | Sabranski et al. | 102/307 |
| 4,702,171 | 10/1987 | Tal et al. | 102/476 |
| 4,724,767 | 2/1988 | Aseltine | 102/307 |
| 4,766,813 | 8/1988 | Winter et al. | 102/307 |
| 5,166,469 | 11/1992 | Kerdraon et al. | 102/308 X |
| 5,221,808 | 6/1993 | Werner et al. | 102/307 |

OTHER PUBLICATIONS

Aseltine "Design of a Charge with a Double, Inverse Velocity Gradient", 13th International Symposium on Ballistics, Stokholm, 1–3 Jun. 1992, pp. 505–512 (WM–25/1–25/8).

*Primary Examiner*—Peter A. Nelson
*Attorney, Agent, or Firm*—Edward W. Callan

[57] ABSTRACT

In a shaped-charge device, the liner is so shaped that bulges are formed in the jet without causing the jet to deviate from the central axis. The shaped-charge device includes a case defining an axisymmetrical forwardly-opening cavity uniformly disposed about a central axis; an axisymmetrical, homogeneous-material, liner of variable thickness defining a forwardly-opening cavity having a closed apex, with the cavity being uniformly disposed within the casing about the central axis; and explosive material symmetrically disposed between the casing and the liner. The liner is so shaped that in response to the explosive material being detonated to thereby explode, the liner is progressively collapsed inward by the exploding material to be formed into a fluid jet of the homogeneous liner material that is forwardly expelled at a varying velocity from the casing along the central axis, with the forward portion of the jet being squeezed from the apex of the collapsing liner. The rate of change of liner thickness with respect to liner axial position varies such that, after the formation of the forward portion of the jet, the velocity of the jet-forming material at at least one intermediate position within the jet varies so as to cause the material to bunch up to form a symmetrical bulge at each intermediate position within the jet, but not such that the velocity of the jet-forming material increases at any such intermediate position while the material is bunching up, thereby inhibiting the material from so bunching up as to cause the jet to deviate from the central axis.

10 Claims, 3 Drawing Sheets

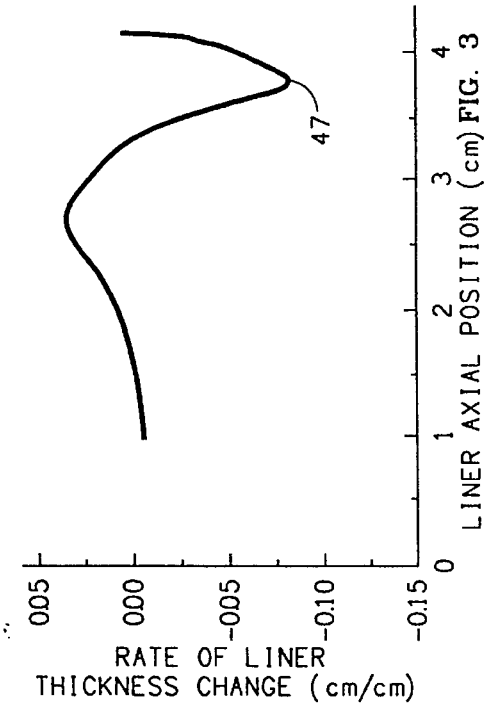
FIG. 3
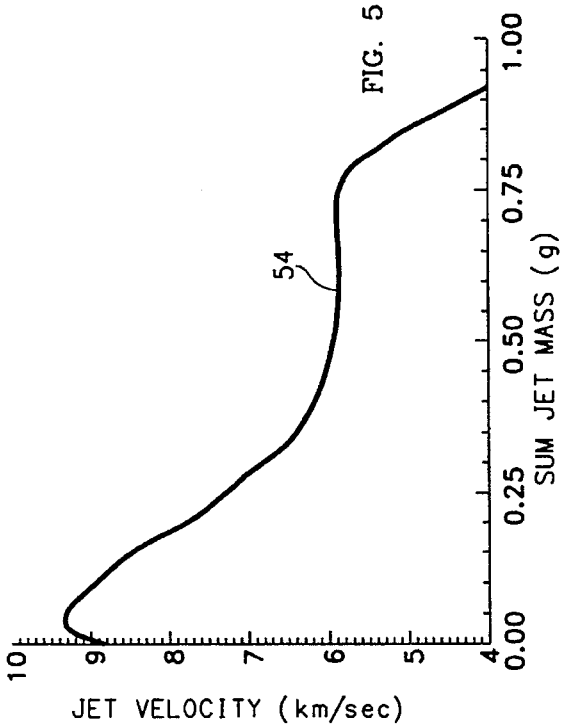
FIG. 5
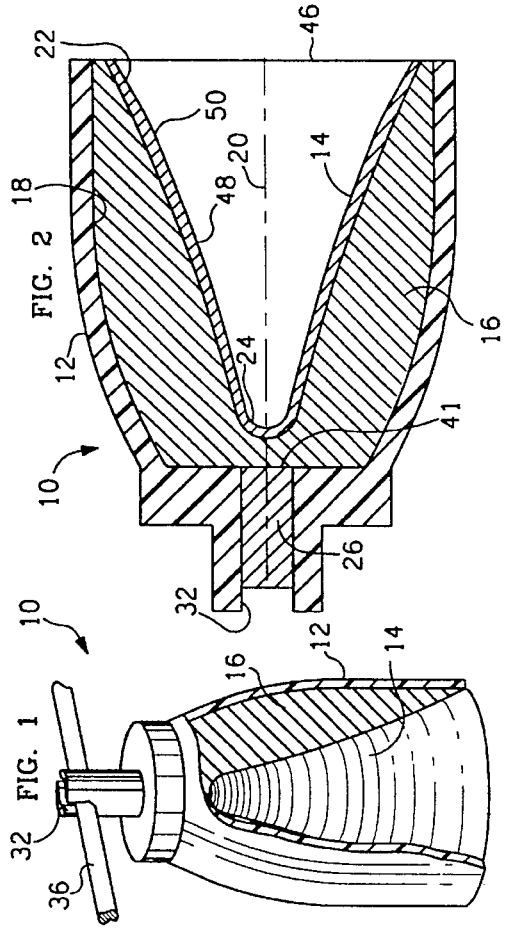
FIG. 2
FIG. 1
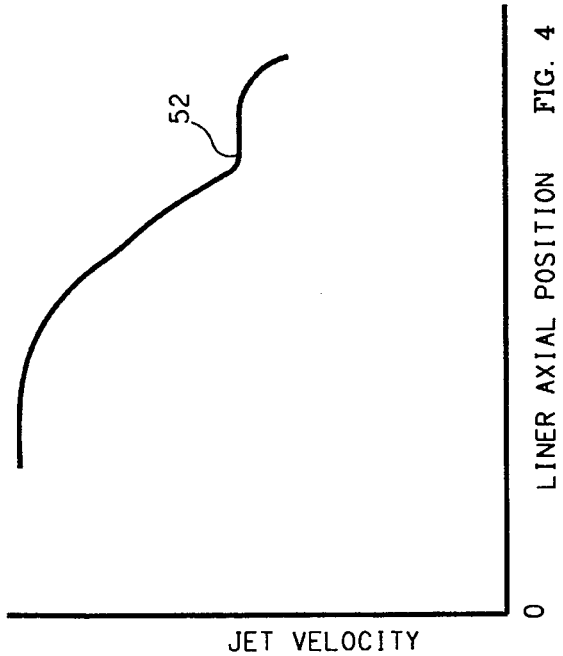
FIG. 4

SHAPED-CHARGE DEVICE WITH PROGRESSIVE INWARD COLLAPSING JET

BACKGROUND OF THE INVENTION

The present invention generally pertains to shaped-charge devices and is particularly directed to improving the accuracy of the trajectory of the jet of liner material expelled therefrom upon detonation of the charge of explosive material contained thereto.

Shaped-charge devices are described in U.S. Pat. Nos. 4,724,767 to Aseltine, 4,436,033 to Precoul and 4,498,367 to Skolnick et al. and by Aseltine "Design of a Charge with a Double, Inverse Velocity Gradient", 13th International Symposium on Ballistics, Stokholm, 1–3 Jun. 1992, pp. 505–512 (WM-25/1–25/8).

A typical shaped-charge device includes a case defining an axisymmetrical forwardly-opening cavity uniformly disposed about a central axis; an axisymmetrical, homogeneous-material, liner of variable thickness defining a forwardly-opening cavity having a closed apex, with the cavity being uniformly disposed within the casing about the central axis; and explosive material symmetrically disposed between the casing and the liner; wherein the liner is so shaped that in response to the explosive material being detonated to thereby explode, the liner is progressively collapsed inward by the exploding material to be formed into a fluid jet of the homogeneous liner material that is forwardly expelled at a varying velocity from the casing along the central axis, with the forward portion of the jet being squeezed from the apex of the collapsing liner.

One use of a shaped-charge device is to provide a high velocity jet for penetrating a metal casing, such as a well casing. Aseltine has described the formation of the jet in such a manner that the jet includes at least one bulge at an intermediate position within the jet so as to provide enough concentrated mass at such intermediate position as to be able to penetrate the casing. The bulge applies the amount of pressure against the casing that would be applied if the explosive charge were larger and the jet did not include a bulge and thereby enables use of a smaller charge to achieve penetration.

Another use of a shaped-charge devices is to detonate buried munitions, such as land mines, by penetrating the casing of the munition with a high velocity jet expelled from a shaped-charge device. Because the shaped-charge device is disposed on the ground surface whereby the jet has to travel through a depth of soil before contacting the buried munition, the jet must be expelled at a high velocity and include at least one bulge for penetrating and detonating the buried munition; and it is desired that the trajectory of the jet not significantly deviate from the central axis of the shaped-charge device so that fewer shaped-charge devices are required for detonating all of the munitions buried within a given area. It has been ascertained that the trajectory of the jet expelled from the shaped-charge device described by Aseltine frequently deviates from the central axis of the shaped-charge device because as the bulge is being formed within the jet, the homogeneous material with which the jet is being formed frequently bunches up in such a manner as to cause the jet to deviate from the central axis.

SUMMARY OF THE INVENTION

The present invention provides a shaped-charge device in which the liner is so shaped that bulges are formed in the jet without causing the jet to deviate from the central axis.

The present invention provides a shaped-charge device, comprising a case defining an axisymmetrical forwardly-opening cavity uniformly disposed about a central axis; an axisymmetrical, homogeneous-material, liner of variable thickness defining a forwardly-opening cavity having a closed apex, with the cavity being uniformly disposed within the casing about the central axis; and explosive material symmetrically disposed between the casing and the liner; wherein the liner is so shaped that in response to the explosive material being detonated to thereby explode, the liner is progressively collapsed inward by the exploding material to be formed into a fluid jet of said homogeneous liner material that is forwardly expelled at a varying velocity from the casing along the central axis, with the forward portion of the jet being squeezed from the apex of the collapsing liner; wherein the angle of disposition of the liner with respect to the central axis and the liner thickness both increase from a position forward of the apex to a more forward position between the apex and the forward end of the cavity to thereby provide a rapidly-elongating coherent jet; and wherein the rate of change of liner thickness with respect to liner axial position varies such that, after the formation of the forward portion of the jet, the velocity of the jet-forming material at at least one intermediate position within the jet varies so as to cause the material to bunch up to form a symmetrical bulge at each said intermediate position within the jet, but not such that the velocity of the jet-forming material increases at any said intermediate position while the material is bunching up, thereby inhibiting the material from so bunching up as to cause the jet to deviate from the central axis.

Accordingly, the shaped-charge device of the present invention is particularly useful for detonating buried munitions or other unexploded ordnance.

Additional features of the present invention are described with reference to the detailed description of the preferred embodiments.

BRIEF DESCRIPTION OF THE DRAWING

FIG. 1 is a perspective view of a shaped-charge device according to the present invention with portions of the casing and the explosive material broken away to better illustrate the liner.

FIG. 2 is a sectional view of a preferred embodiment of the shaped charge device of the present invention, in which the liner is shaped for forming a jet with a single bulge.

FIG. 3 is a graph showing the rate of change of liner thickness with respect to liner axial position for a preferred embodiment of the shaped-charge device of FIG. 2.

FIG. 4 is a graph showing the velocity of the homogeneous material within the jet at different axial positions as the jet is being formed at a given time after the formation of the forward portion of the jet from the liner of the shaped-charge device of FIG. 2.

FIG. 5 is a graph showing the velocity of the jet as the jet is being formed from the shaped-charge device of FIG. 2, as measured by the accumulated sum of the jet mass.

DETAILED DESCRIPTION

Figure 6A:
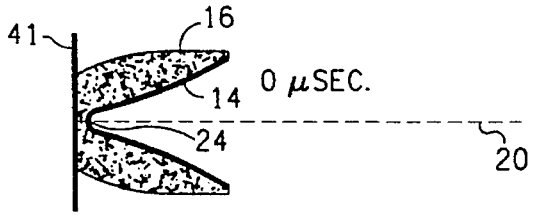
FIGS. 6A through 6H are a series of section views showing the formation of the jet from the shaped-charge device of FIG. 2 at various times commencing with detonation of the explosive material.

Referring to FIGS. 1 and 2, one preferred embodiment of the shaped-charge device 10 of the present invention includes a case 12, a homogeneous-material liner 14 and explosive material 16.

The case 12 defines an axisymmetrical forwardly-opening cavity 18 uniformly disposed about a central axis 20. Preferably, the case 12 is a polycarbonate plastic material.

The liner 14 is axisymmetrical and defines a forwardly-opening cavity 22 having a closed apex 24. The liner cavity 22 is uniformly disposed within the case 12 about the central axis 20. Preferably, the liner 14 is a metal such as oxygen-free, high-conductivity copper.

The explosive material 16 is symmetrically disposed between the case 12 and the liner 14. Preferably, the explosive material 16 is a modem high-explosive material, such as RDX-based or HMX-based explosive material.

The shaped-charge device 10 further includes a slot 32 at the opposite end of the case 12 from the forward end of the cavity 18. Detonating material 26 is disposed in the slot 32 to contact the explosive material 16. A detonator cord 36 is disposed in the slot 32 for contacting the detonating material 26. In an alternative embodiment (not shown), an exploding bridge wire, instead of the detonator cord 36, is placed in the slot 32 to contact the detonating material 26. Cords of a net (not shown) also may be tied through the slot 32 so that a plurality of the shaped-charged devices 10 can be disposed at positions on the ground surface defined by the net. In one application of the present invention, thousands of the shaped-charge devices 10 are so attached to a net that is spread over a given area so that any munitions buried beneath such area are detonated in response to the shaped-charge devices being detonated to form jets that pass through the ground and penetrate and detonate the buried munitions.

Figure 6B:
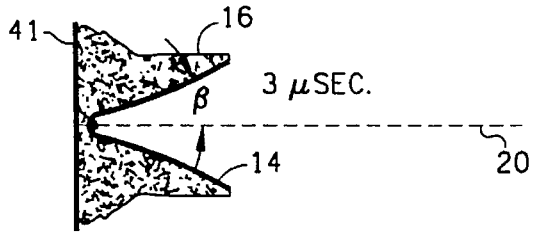
Figure 6C:
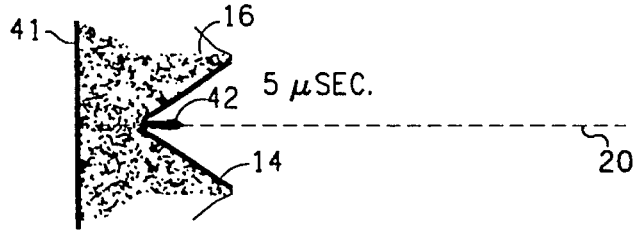
Figure 6D:
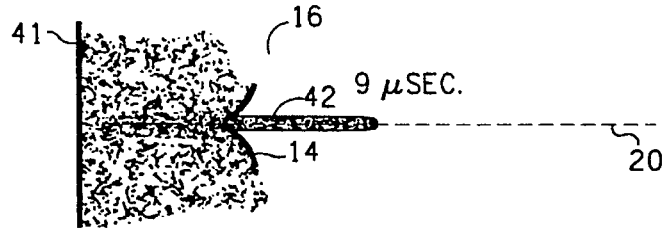
Figure 6E:
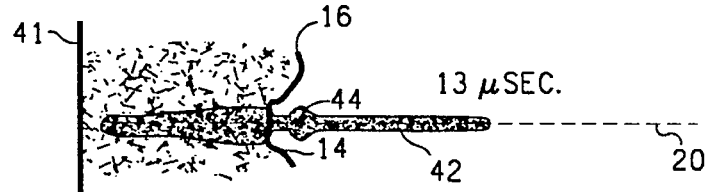
Figure 6F:
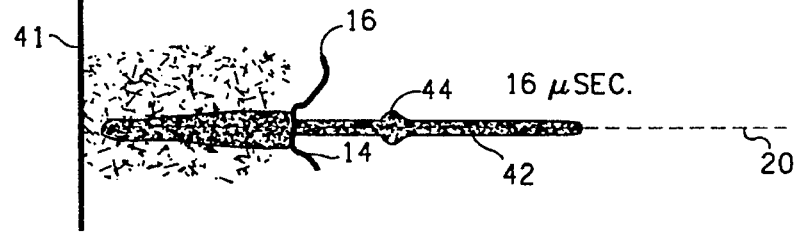
Figure 6G:
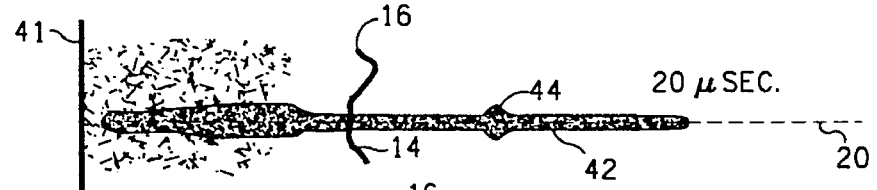
Figure 6H:
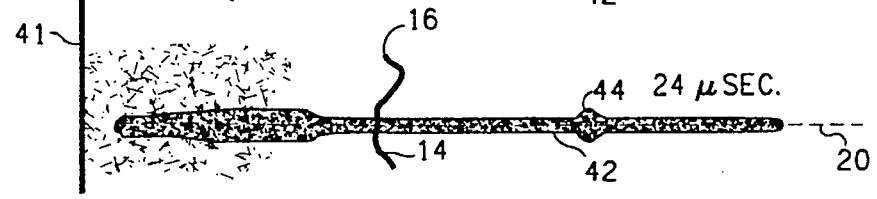

Referring to FIG. 6A through 6H, in response to the explosive material 16 being detonated to thereby explode, the liner 14 is progressively collapsed inward by the exploding material 16 to be formed into a fluid jet 42 of the homogeneous material that is forwardly expelled at a varying velocity from the case along the central axis 20, with the forward portion of the jet being squeezed from the apex 24 of the collapsing liner 14. The reference plane 41 in FIG. 6A through 6H is the boundary between the detonation material 26 and the explosive material 16. The view of FIG. 6A is at the instant that detonation of the explosive material 16 is initiated. The duration after initiation of detonation for FIG 6B is 3 microseconds; for FIG. 6C is 5 microseconds; for FIG. 6D is 9 microseconds; for FIG. 6E is 13 microseconds; for FIG. 6F is 15 microseconds; for FIG. 6G is 20 microseconds; and for FIG. 6H is 24 microseconds. Referring to FIG. 6E, as the jet 42 is being formed, the homogeneous liner-material bunches up to form a symmetrical bulge 44 at an intermediate position within the jet 42.

The liner 14 is of variable thickness and shaped as shown in FIG. 2. In order to provide the rapidly-elongating coherent jet 42 shown in FIG. 6B through 6H, the angle of disposition of the liner 14 with respect to the central axis 20 at and forward of the apex 24, and the liner thickness profile are such as to achieve a low angle β of liner collapse with respect to the central axis 20 and a high rate of homogeneous material flow. As shown in FIG. 2, the angle of disposition and the liner thickness both gradually increase from a position forward of the apex 24 to a more forward position between the apex 24 and the forward end 46 of the cavity 22.

The "x" and "y" coordinates for the outside of the liner 14 and the thickness of the liner 14 for a preferred embodiment of the shaped-charge device of FIG. 2 are set forth in Table I. The "x" dimension is from the forward end 46 of the cavity 22 in a direction parallel to the central axis 20 and the "y" dimension is from the central axis 20 in a direction normal to the central axis 20.

TABLE I

| | Outside Coordinates (cm.) | | |
|---|---|---|---|
| Index | x | y | Thickness (cm.) |
| 1 | 3.2207 | 0.2578 | 0.0664 |
| 2 | 3.0775 | 0.2943 | 0.0654 |
| 3 | 2.9224 | 0.3338 | 0.0644 |
| 4 | 2.7578 | 0.3767 | 0.0635 |
| 5 | 2.5864 | 0.4229 | 0.0628 |
| 6 | 2.4104 | 0.4724 | 0.0624 |
| 7 | 2.2321 | 0.5248 | 0.0624 |
| 8 | 2.0536 | 0.5798 | 0.0631 |
| 9 | 1.8769 | 0.6368 | 0.0648 |
| 10 | 1.7037 | 0.6952 | 0.0676 |
| 11 | 1.5357 | 0.7545 | 0.0719 |
| 12 | 1.3741 | 0.8138 | 0.0768 |
| 13 | 1.2203 | 0.8726 | 0.0810 |
| 14 | 1.0751 | 0.9302 | 0.0839 |
| 15 | 0.9392 | 0.9860 | 0.0853 |
| 16 | 0.8131 | 1.0394 | 0.0854 |
| 17 | 0.6969 | 1.0900 | 0.0840 |
| 18 | 0.5904 | 1.1375 | 0.0809 |
| 19 | 0.4932 | 1.1818 | 0.0756 |
| 20 | 0.4045 | 1.2228 | 0.0687 |
| 21 | 0.3232 | 1.2608 | 0.0616 |
| 22 | 0.2478 | 1.2962 | 0.0555 |
| 23 | 0.1765 | 1.3297 | 0.0506 |
| 24 | 0.1069 | 1.3622 | 0.0466 |
| 25 | 0.0365 | 1.3951 | 0.0433 |
| 26 | 0.0000 | 1.4121 | 0.0421 |

The focus of the curve defining the apex 24 of the inside of the liner 14 is located 3.1527 cm from the forward end 46 of the cavity 22 and has a radius of 0.2002 cm. The focus of the curve defining the apex 24 of the outside of the liner 14 is located 3.1542 cm. from the forward end 46 of the cavity 22 and has a radius of 0.2662 cm.

A graph of the rate of change of liner thickness with respect to liner axial position from the reference plane 41 for the preferred embodiment of the shaped-charge device of FIG. 2 having the liner coordinates and thickness set forth in Table I is shown in FIG. 3. The reversal in the negative rate of change of liner thickness, as shown at point 47 in the graph of FIG. 3, causes the formation of the bulge 44 in the jet 42.

In order to provide a rapidly-elongating coherent jet 42 having a bulge 44 at an intermediate position within the jet 42, as shown in FIG. 6E through 6H, the angle of disposition of the liner 14 gradually increases from a position immediately forward of the apex 24 to a position at the forward end 46 of the cavity 22; and the liner thickness increases from a position 48 forward of the apex 24 to an intermediate more forward position 50 between the apex 24 and the forward end 46 of the cavity 22 and then decreases from the intermediate position 50 to the forward end 46 of the cavity 22, with the rate of the decrease in liner thickness increasing and then decreasing to thereby provide the rapidly-elongating coherent jet 42 and to thereby cause the liner material to bunch up to form the symmetrical bulge 44 at an intermediate position within the jet 42.

In order to inhibit the liner-material from so bunching up during the formation of the bulge 44 as to cause the jet 42 to deviate from the central axis 20, the rate of change of liner thickness with respect to liner axial position from the reference plane 41 varies such that, after the formation of the forward portion of the jet 42, the velocity of the jet-forming material does not increase at the intermediate position within the jet 42 where the bulge 44 is formed while the material is bunching up.

Accordingly, the velocity of the homogeneous material within the 42 jet at different axial positions as the jet is being formed at a given time after the formation of the forward portion of the jet 42, as shown in FIG. 4, is controlled in accordance with the rate of change of liner thickness with respect to liner axial position from the reference plane 41 such that the velocity of the jet-forming material at the intermediate bulge-forming position 44 within the jet 42, as illustrated at 52 in FIG. 4, is either zero or decreasing at a lesser rate than the velocity of the jet-forming material fore and aft of the intermediate bulge-forming position 44.

Referring to the graph of FIG. 5 showing the velocity of the jet 42 as the jet 42 is being formed from the liner 14, as measured by the accumulated sum of the jet mass, the velocity of the homogeneous material within the 42 jet is controlled in accordance with the velocity of the homogeneous material within the 42 jet is controlled in accordance with the rate of change of liner thickness with respect to liner axial position such that the velocity of the jet-forming material at the intermediate bulge-forming position 44 within the jet 42, as illustrated at 54 in FIG. 5, is either zero or decreasing at a lesser rate than the velocity of the jet-forming material while forming those portions of the jet 42 fore and aft of the intermediate bulge-forming position 44.

Figure 7:
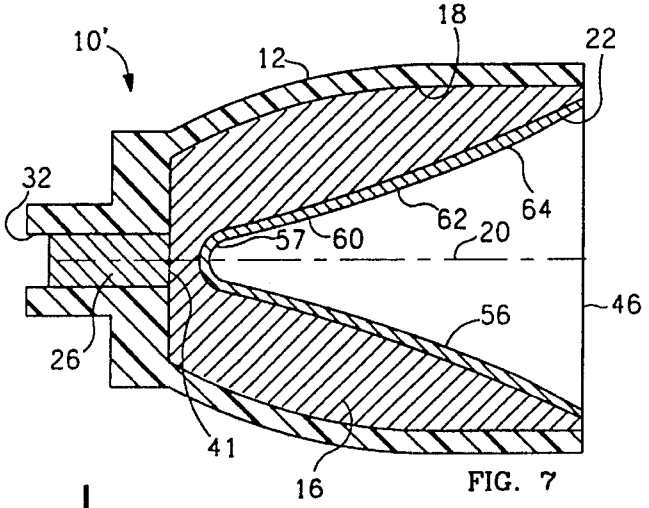
FIG. 7 is a sectional view of a preferred embodiment of the shaped charge device of the present invention, in which the liner is shaped for forming a jet with two bulges.

Referring to FIG. 7, another embodiment of the shaped charge device 10' includes a liner 56 that is shaped for forming a jet with two bulges. In other respects the embodiment of the shaped-charge device shown in FIG. 7 is identical to the embodiment of the shaped-charge device described above with reference to FIG. 2. The second bulge of a let having two bulges applies enough force to detonate an explosive charge inside of a casing penetrated by the force of the first bulge of the jet in the event that the force of the first bulge is spent in effecting penetration and does not accomplish such detonation.

The liner 56 is of variable thickness and shaped as shown in FIG. 7. In order to provide a rapidly-elongating coherent jet, the angle of disposition of the liner 56 with respect to the central axis 20 at and forward of the apex 57, and the liner thickness profile are such as to achieve a low angle of liner collapse with respect to the central axis 20 and a high rate of homogeneous material flow. As shown in FIG. 7, the angle of disposition and the liner thickness both gradually increase from a position forward of the apex 57 to a more forward position between the apex 57 and the forward end 46 of the cavity 22.

The "x" and "y" coordinates for the outside of the liner 56 and the thickness of the liner 56 for a preferred embodiment of the shaped-charge device of FIG. 7 are set forth in Table II. The "x" dimension is from the forward end 46 of the cavity 22 in a direction parallel to the central axis 20 and the "y" dimension is from the central axis 20 in a direction normal to the central axis 20.

TABLE II

| | Outside Coordinates (cm.) | | |
|---|---|---|---|
| Index | x | y | Thickness (cm.) |
| 1 | 3.1171 | 0.2734 | 0.0836 |
| 2 | 3.0070 | 0.3006 | 0.0816 |
| 3 | 2.8948 | 0.3287 | 0.0795 |
| 4 | 2.7799 | 0.3582 | 0.0774 |
| 5 | 2.6619 | 0.3897 | 0.0758 |
| 6 | 2.5406 | 0.4233 | 0.0741 |
| 7 | 2.4157 | 0.4594 | 0.0728 |
| 8 | 2.2873 | 0.4981 | 0.0716 |
| 9 | 2.1553 | 0.5396 | 0.0713 |
| 10 | 2.0200 | 0.5838 | 0.0716 |
| 11 | 1.8817 | 0.6308 | 0.0728 |
| 12 | 1.7406 | 0.6804 | 0.0755 |
| 13 | 1.5974 | 0.7326 | 0.0798 |
| 14 | 1.4526 | 0.7870 | 0.0855 |
| 15 | 1.3070 | 0.8433 | 0.0914 |
| 16 | 1.1613 | 0.9011 | 0.0958 |
| 17 | 1.0165 | 0.9600 | 0.0972 |
| 18 | 0.8737 | 1.0195 | 0.0940 |
| 19 | 0.7340 | 1.0790 | 0.0898 |
| 20 | 0.5987 | 1.1378 | 0.0884 |
| 21 | 0.4692 | 1.1952 | 0.0803 |
| 22 | 0.3469 | 1.2503 | 0.0683 |
| 23 | 0.2334 | 1.3022 | 0.0566 |
| 24 | 0.1305 | 1.3501 | 0.0490 |
| 25 | 0.0400 | 1.3930 | 0.0473 |
| 26 | 0.0000 | 1.4121 | 0.0477 |

The focus of the curve defining the apex 57 of the inside of the liner 56 is located 3.0460 cm from the forward end 46 of the cavity 22 and has a radius of 0.1989 cm. The focus of the curve defining the apex 57 of the outside of the liner 56 is located 3.0498 cm. from the forward end 46 of the cavity 22 and has a radius of 0.2814 cm.

Figure 8:
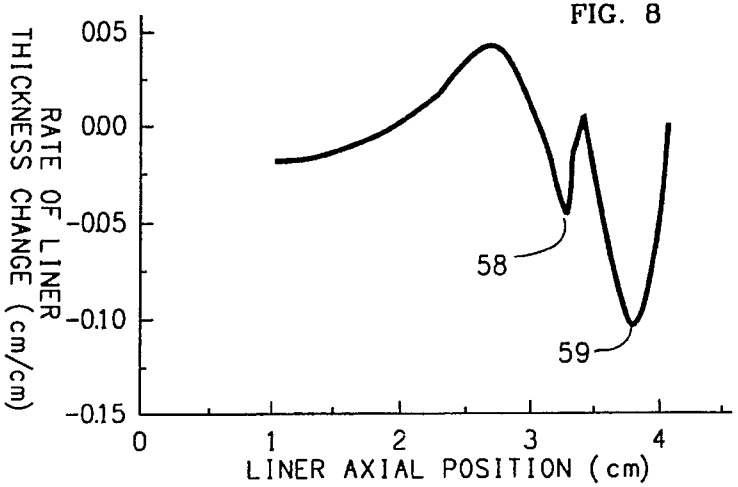
FIG. 8 is a graph showing the rate of change of liner thickness with respect to liner axial position for a preferred embodiment of the shaped-charge device of FIG. 7.

A graph of the rate of change of liner thickness with respect to liner axial position from the reference plane 41 for the preferred embodiment of the shaped-charge device of FIG. 7 having the liner coordinates and thickness set forth in Table II is shown in FIG. 8. The two reversals in the negative rate of change of liner thickness, as shown at points 58 and 59 in FIG. 8, causes the formation of two bulges in the jet produced upon collapse of the liner 56 in response to detonation of the explosive material 16.

In order to provide a rapidly-elongating coherent jet having two bulges at different intermediate positions within the jet, the angle of disposition of the liner 56 gradually increases from a position immediately forward of the apex 24 to a position at the forward end 46 of the cavity 22; and the liner thickness increases from a position 60 immediately forward of the apex 24 to a first intermediate more forward position 62 between the apex 24 and the forward end 46 of the cavity 22 and then decreases from the first intermediate position 62 to a second intermediate position 64 between the first intermediate position 62 and the forward end 46 of the cavity 22 and subsequently decreases to the forward end 46 of the cavity 22 from a position that is at least as far forward as the second intermediate position 64, with the rate of each of the two decreases in liner thickness increasing and then decreasing to thereby cause the jet to elongate rapidly while remaining coherent and to thereby cause the liner material to bunch up to form two symmetrical bulges at intermediate positions within the jet.

In order to inhibit the liner-material from so bunching up during the formation of the two bulges as to cause the jet to deviate from the central axis, the rate of change of liner thickness with respect to liner axial position from the reference plane 41 varies such that, after the formation of the forward portion of the jet, the velocity of the jet-forming material does not increase at such intermediate positions within the jet where the bulges are formed while the material is bunching up.

Figure 10:
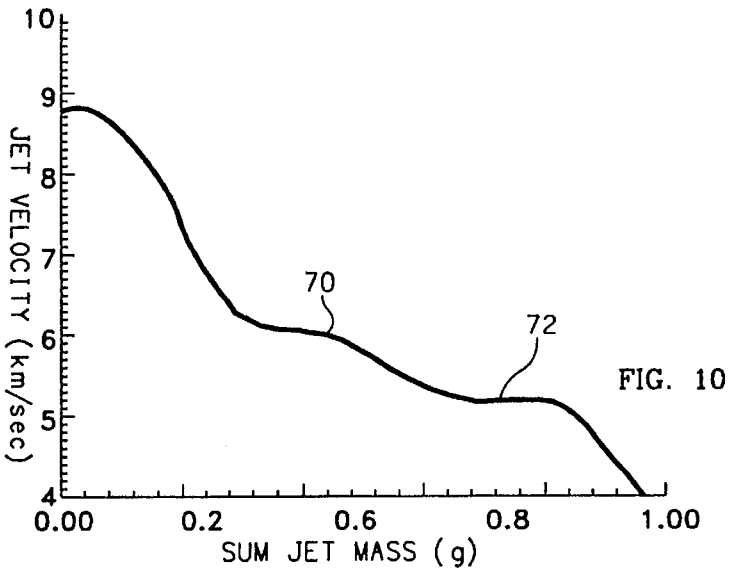
FIG. 10 is a graph showing the velocity of the jet as the jet is being formed from the shaped-charge device of FIG. 7, as measured by the accumulated sum of the jet mass.
Figure 9:
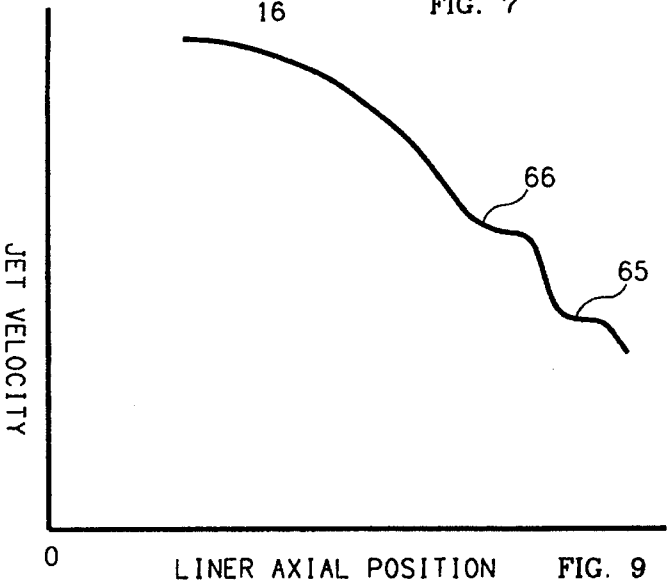
FIG. 9 is a graph showing the velocity of the homogeneous material within the jet at different axial positions as the jet is being formed at a given time after the formation of the forward portion of the jet from the liner of the shaped-charge device of FIG. 7.

Accordingly, the velocity of the homogeneous material within the jet at different axial positions as the jet is being formed at a given time after the formation of the forward portion of the jet, as shown in FIG. 9, is controlled in accordance with the rate of change of liner thickness with respect to liner axial position from the reference plane 41 such that the velocity of the jet-forming material at the intermediate bulge-forming positions within the jet, as illustrated at 66 and 68 in FIG. 9, is either zero or decreasing at a lesser rate than Referring to the graph of FIG. 10 showing the velocity of the jet as the jet is being formed from the liner 56, as measured by the accumulated sum of the jet mass, the velocity of the homogeneous material within the jet is controlled in accordance with the rate of change of liner thickness with respect to liner axial position from the reference plane 41 such that the velocity of the jet-forming material at the intermediate bulge-forming positions within the jet, as illustrated at 70 and 72 in FIG. 10, is either zero or decreasing at a lesser rate than the velocity of the jet-forming material while forming those portions of the jet fore and aft of the respective intermediate bulge-forming positions.

In other embodiments of the shaped charge device of the present invention the liner is shaped for forming a jet with more than two bulges.

The advantages specifically stated herein do not necessarily apply to every conceivable embodiment of the present invention. Further, such stated advantages of the present invention are only examples and should not be construed as the only advantages of the present invention.

While the above description contains many specificities, these should not be construed as limitations on the scope of the present invention, but rather as examples of the preferred embodiments described herein. Other variations are possible and the scope of the present invention should be determined not by the embodiments described herein but rather by the claims and their legal equivalents.

We claim:

1. A shaped-charge device, comprising a case defining an axisymmetrical forwardly-opening cavity uniformly disposed about a central axis;

an axisymmetrical, homogeneous-material, liner of variable thickness defining a forwardly-opening cavity having a closed apex, with the cavity being uniformly disposed within the case about the central axis; and explosive material symmetrically disposed between the case and the liner;

wherein the liner is so shaped that in response to the explosive material being detonated to thereby explode, the liner is progressively collapsed inward by the exploding material to be formed into a fluid jet of said homogeneous liner material that is forwardly expelled at a varying velocity from the case along the central axis, with the forward portion of the jet being squeezed from the apex of the collapsing liner;

wherein the angle of disposition of the liner with respect to the central axis and the liner thickness both increase from a position forward of the apex to a more forward position between the apex and the forward end of the cavity to thereby provide a rapidly-elongating coherent jet; and wherein the rate of change of liner thickness with respect to liner axial position varies such that, after the formation of the forward portion of the jet, the velocity of the jet-forming material at at least one intermediate position within the jet varies so as to cause the material to bunch up to form a symmetrical bulge at each said intermediate position within the jet, but not such that the velocity of the jet-forming material increases at any said intermediate position while the material is bunching up, thereby inhibiting the material from so bunching up as to cause the jet to deviate from the central axis.

2. A shaped-charge device according to claim 1, wherein the rate of change of liner thickness with respect to liner axial position varies such that, after the formation of the forward portion of the jet, the velocity of the jet-forming material at each said intermediate position within the jet is either zero or decreasing at a lesser rate than the velocity of the jet-forming material fore and aft of the respective said intermediate position.

3. A shaped-charge device according to claim 1, wherein the rate of change of liner thickness with respect to liner axial position varies such that the velocity of the jet as the jet is being formed, as measured by the accumulated sum of the jet mass, is either zero or decreasing at a lesser rate than the velocity of the jet-forming material while forming those portions of the jet fore and aft of each said intermediate position.

4. A shaped-charge device according to claim 1, wherein the rate of change of liner thickness with respect to liner axial position varies such that, after the formation of the forward portion of the jet, the velocity of the jet-forming material at each of two said intermediate positions within the jet is either zero or decreasing at a lesser rate than the velocity of the jet-forming material fore and aft of the respective said intermediate position.

5. A shaped-charge device according to claim 1, wherein the rate of change of liner thickness with respect to liner axial position varies such that the velocity of the jet as the jet is being formed, as measured by the accumulated sum of the jet mass, is either zero or decreasing at a lesser rate than the velocity of the jet-forming material while respectively forming those portions of the jet fore and aft of each of two said intermediate positions.

6. A shaped-charge device according to claim 1, wherein the angle of disposition of the liner with respect to the central axis at and forward of the apex and the liner thickness profile are such as to achieve a low angle of liner collapse with respect to the central axis and a high rate of homogeneous material to thereby provide a rapidly-elongating coherent jet.

7. A shaped-charge device according to claim 1, wherein the liner thickness increases from a position forward of the apex to a first intermediate more forward position between the apex and the forward end of the cavity and then decreases from the first intermediate position to a second intermediate position between the first intermediate position and the forward end of the cavity and subsequently decreases to the forward end of the cavity from a position that is at least as far forward as the second intermediate position, with the rate of each of the two decreases in liner thickness increasing and then decreasing to thereby cause the jet to elongate rapidly while remaining coherent and to thereby cause the liner material to bunch up to form two symmetrical bulges at intermediate positions within the jet.

8. A shaped-charge device according to claim 1, wherein the angle of disposition of the liner with respect to the central axis increases from a position immediately forward of the apex to a position at the forward end of the cavity and the liner thickness increases from a position forward of the apex to an intermediate position between the apex and the forward end of the cavity and then decreases from the intermediate position to the forward end of the cavity, with the rate of the decrease in liner thickness increasing and then decreasing to thereby cause the jet to elongate rapidly while remaining coherent and to thereby cause the liner material to bunch up to form the symmetrical bulge at an intermediate position within the jet.

9. A shaped-charge device according to claim 1, wherein the angle of disposition of the liner with respect to the central axis increases from a position immediately forward of the apex to a position at the forward end of the cavity and the liner thickness increases from a position forward of the apex to a first intermediate more forward position between the apex and the forward end of the cavity and then decreases from the first intermediate position to a second intermediate position between the first intermediate position and the forward end of the cavity and subsequently decreases to the forward end of the cavity from a position that is at least as far forward as the second intermediate position, with the rate of each of the two decreases in liner thickness increasing and then decreasing to thereby cause the jet to elongate rapidly while remaining coherent and to thereby cause the liner material to bunch up to form two symmetrical bulges at intermediate positions within the jet.

10. A shaped-charge device according to claim 1, wherein the liner thickness increases from a position forward of the apex to an intermediate position between the apex and the forward end of the cavity and then decreases from the intermediate position to the forward end of the cavity, with the rate of the decrease in liner thickness increasing and then decreasing to thereby cause the jet to elongate rapidly while remaining coherent and to thereby cause the liner material to bunch up to form the symmetrical bulge at an intermediate position within the jet.

* * * * *

UNITED STATES PATENT AND TRADEMARK OFFICE

CERTIFICATE OF CORRECTION

PATENT NO. : 5,614,692

DATED : March 25, 1997

INVENTOR(S) : Ronald E. Brown and Mark E. Majerus

It is certified that error appears in the above-indentified patent and that said Letters Patent is hereby corrected as shown below:

Column 1, line 10, "thereto" should read --therein--.

Column 5, line 49, "let" should read --jet--.

Column 7, line 19, after "than" --the velocity of the jet-forming material fore and aft of the respective said intermediate position.-- should be inserted.

Signed and Sealed this

Twelfth Day of August, 1997

Bruce Lehman

*Attest:*

BRUCE LEHMAN

*Attesting Officer*

*Commissioner of Patents and Trademarks*